United States Patent [19]

DeJean, Jr.

[11] Patent Number: 4,729,334

[45] Date of Patent: Mar. 8, 1988

[54] COMMERCIAL SPORT FISHING BOAT

[76] Inventor: Prescott L. DeJean, Jr., 3606 Third Ave. N, Texas City, Tex. 77590

[21] Appl. No.: 919,802

[22] Filed: Oct. 16, 1986

[51] Int. Cl.[4] ..... B63B 35/14

[52] U.S. Cl. ..... 114/255; 114/71; 114/85; 114/361; 114/363

[58] Field of Search ..... 114/56, 71, 85, 255, 114/343, 363, 364, 361; D12/300, 315, 318

[56] References Cited

U.S. PATENT DOCUMENTS 1,123,068 12/1914 Barney ..... 114/71

FOREIGN PATENT DOCUMENTS 31683 3/1980 Japan ..... 114/71

107983 7/1982 Japan ..... 114/343

OTHER PUBLICATIONS

"Hatteras 37 Convertible", Hatteras Yachts, High Point, N.C. 27261, Jun. 1978.

*Primary Examiner*—Sherman D. Basinger

*Attorney, Agent, or Firm*—Russell J. Egan

[57] ABSTRACT

A commercial sport fishing boat has an upper deck plan which includes forwardly directed walkways extending along either side of a central cabin. The cabin side walls are formed such that they define outwardly directed benches adjacent each walkway while providing adequate interior overhead in the cabin. The walkways and benches increase the boat's linear rail space and therefor the sport fisherman capacity. The boat further includes the conventional equipment of this type of craft.

12 Claims, 8 Drawing Figures

COMMERCIAL SPORT FISHING BOAT

BACKGROUND OF THE INVENTION

1. Field of the Invention

The present invention relates to a boat for commercial sport fishing and in particular to a boat configured to have improved rail and seating capacity without causing any substantial reduction in the available cabin space, particularly cabin head room.

2. Description of the Background

A primary problem facing existing commercial sport fishing boats is to provide an adequate balance between the available rail space for fishing and yet sufficient interior space for the creature comforts required to attract sport fisherman to the boat. For example, many commercial fishing boats in the 40 foot range have limited rail and deck space but are provided with a large salon area which is used for lounging only. While this may allow for the creature comforts, it actually limits the number of sport fisherman that can be taken on board in any one trip, the number being limited by the available rail space. This limitation is a definite economic drawback as it directly relates to the number of paying passengers which can be accommodated on each trip.

Some charter sport fishing boats have been built at the opposite end of this extreme. They have reduced their cabin space significantly or even, in some cases, eliminated it altogether. U.S. Pat. No. 4,033,280 is an example. This has had the effect of increasing the available rail space, but it has definitely limited the comfort or luxury factor. While more paying sport fisherman can be brought on board, perhaps the charge cannot be as high for the individual fisherman on each trip. Thus, there is not necessarily a net gain in profit for the operator of this type of commercial sport fishing boat.

From the foregoing, it is clear that there has been a significant need in the commercial sport fishing area for a boat which can carry a sufficient number of sport fisherman provided with adequate amount of comfort-/luxury as to enable the operator to return a profit over his expenses on each trip.

SUMMARY OF THE INVENTION

It is the intent of the present invention to provide a commercial sport fishing boat, preferably in the 40 foot range, which has adequate cabin space as well as to provide a substantial amount of linear feet of rail space so as to enable a profitable combination per trip of an adequate number of fisherman at a reasonable price.

The subject commercial sport fishing boat has a hull with a lower or cabin deck supported on the hull defining therebetween a below decks equipment space for the engines, fuel, water and like gear normally carried in such a boat. A cabin is provided on a central portion of the lower deck. A main or upper deck disposed in generally parallel relation is spaced above the lower deck and defines forwardly directed walkways to either side of the walls of the cabin. The walkways and adjacent inboard bench seats form a protion of the overhead for the cabin. A flying console is supported substantially centrally of the boat on a flying deck elevated above the main deck and includes all the controls for the engines and steering of the boat. The controls are connected to the engines, etc. through a vertical conduit extending through the decks from the flying console.

The cabin is provided with a complete galley, an electrically operated complete head, a table, benches, a bar/entertainment center and storage. The cabin can be air conditioned.

The main deck has a central portion which can be enclosed by a removable awning. It is also provided with a stepped-down rear portion including fish cleaning and storage stations. The rear transom can be equipped with a port and diving platform.

BRIEF DESCRIPTION OF THE DRAWINGS

The present invention will be described by way of example with reference to the accompanying drawings in which.

DETAILED DESCRIPTION OF THE PREFERRED EMBODIMENT

Figure 1:
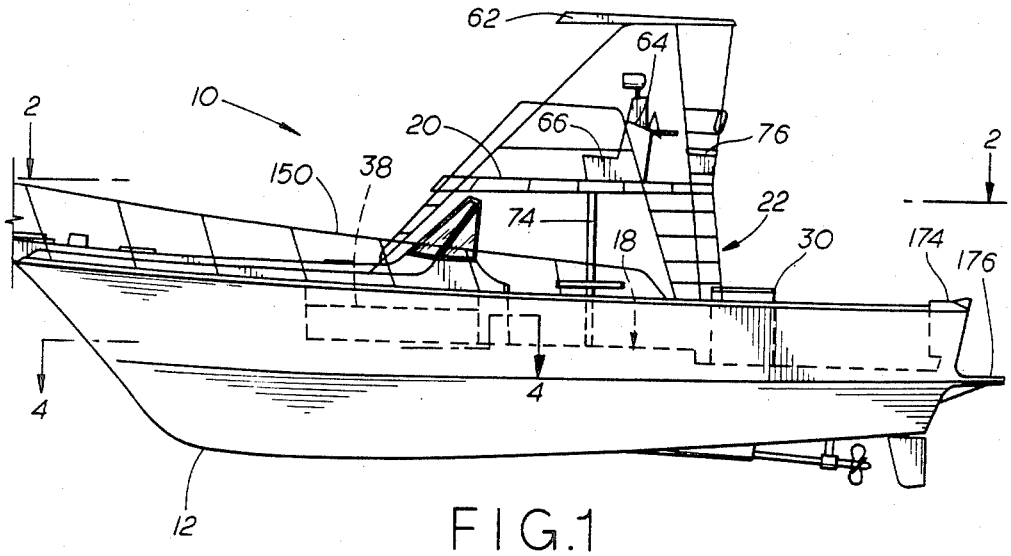
FIG. 1 is side elevation of the subject boat.
Figure 3:
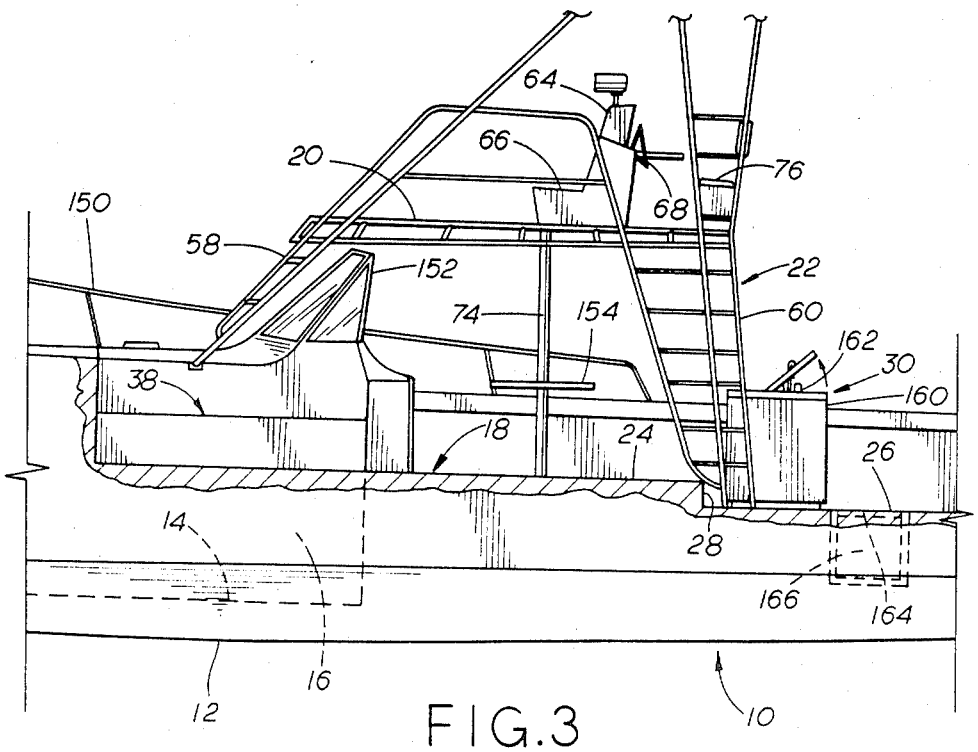
FIG. 3 is a side elevation, partly in section, taken along line 3—3 of FIG. 2.
Figure 4:
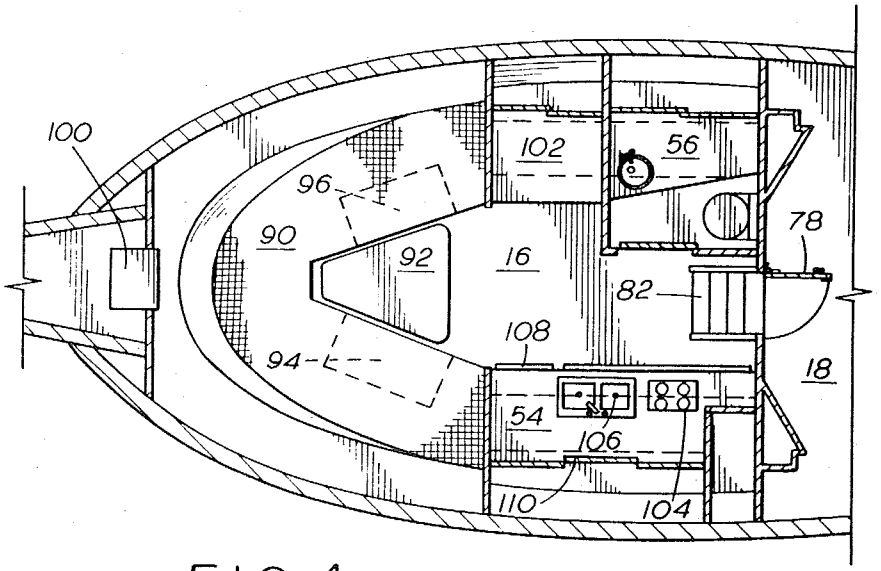
FIG. 4 is a plan view, partly in section, taken along line 4—4 of FIG. 1.

The subject commercial sport fishing boat 10 (FIG. 1) has a hull 12 which supports a cabin or lower deck 14 (FIGS. 3 and 6) supporting a cabin 16 (FIGS. 4 and 6) centrally of the longitudinal axis of the hull and at the forward end thereof. A main or upper deck 18 (FIGS. 2 and 3) is disposed in generally parallel relation spaced above the cabin deck 14. A flying console deck 20 (FIGS. 1, 3 and 5) is supported spaced above the main deck by frame 22.

Figure 2:
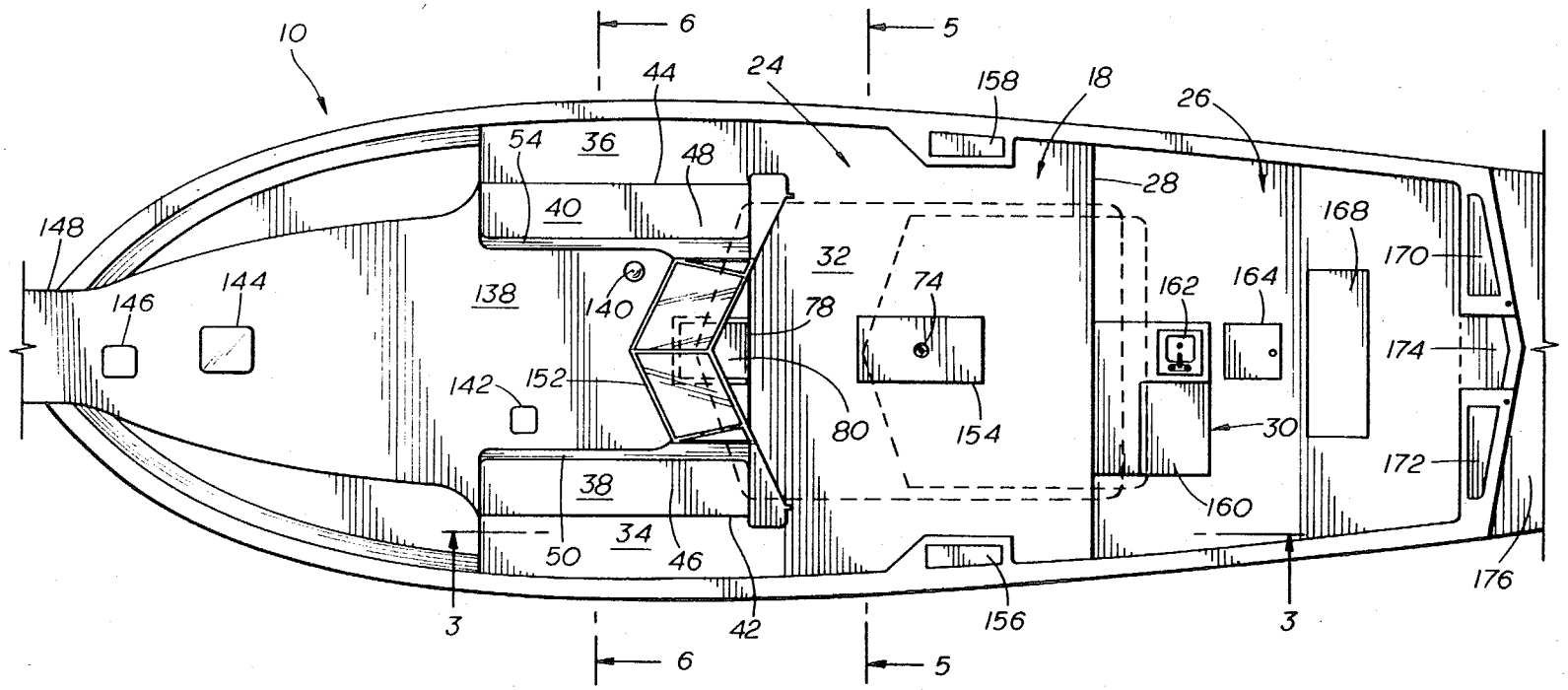
FIG. 2 is a top plan view taken along line 2—2 of FIG. 1.

The main deck 18 (FIGS. 2 and 3) is preferably divided into a forward fishing section 24 and an aft working section 26 which is stepped down at 28 to assure drainage and retention of the debris from the cleaning station 30 in that portion of the boat. Turning now to FIG. 2, it will be appreciated from this figure that the fishing section 24 of the main deck 18 has a generally U-shape opening toward the bow of the boat and formed by a central generally rectangular area 32 and port and starboard walkways 34, 36, respectively, extending between the hull 12 and outwardly facing bench seats 38, 40 on either side of cabin 16. The benches are formed by risers 42, 44, seats 46, 48 and backs 50, 52. The particular advantage of this arrangement can be best appreciated by a comparison of FIGS. 2, 3, 4 and 6. The bench seats 38, 40 form a portion of the overhead for cabin 16 with bench seat 38 being over a galley 54 and the bench seat 40 being over a head 56. Since the construction is preferably reinforced fiberglass, as will be discussed later, no support or framing structure has been shown.

Figure 5:
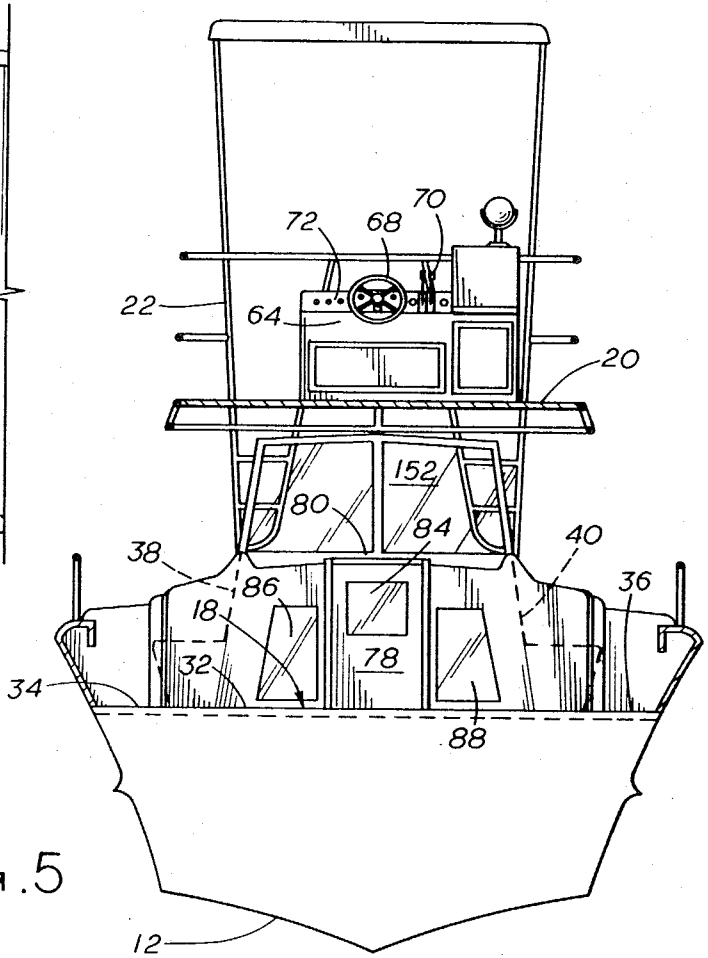
FIG. 5 is a transverse section taken along line 5—5 of FIG. 2.
Figure 6:
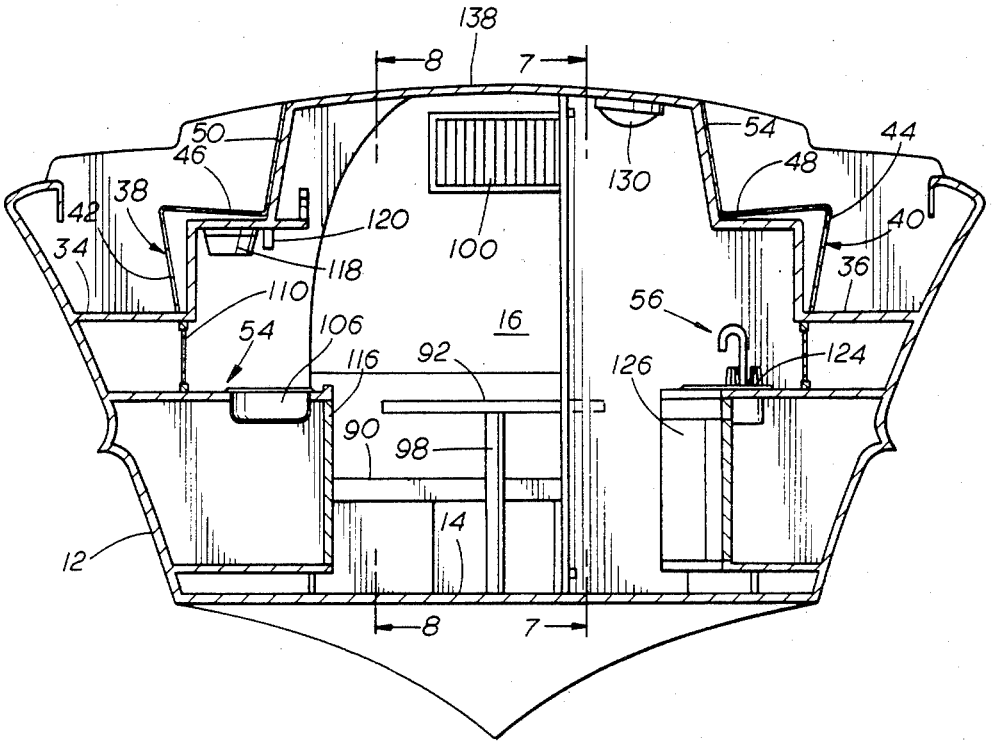
FIG. 6 is a transverse section taken along line 6—6 of FIG. 2.

The frame 22 includes pairs of forward legs 58 and aft legs 60 to support the flying console deck 20 spaced above and parallel to the main deck 18. Portions of the legs 58, 60 extend above the flying console deck 20 to support a roof 62 spaced above and parallel to the flying console deck 20. A control console 64 is mounted on the flying console deck 20 and includes a forwardly directed bench seat 66 as well as the steering controls 68, the power controls 70 and the instrumentation 72 (FIG. 5). The controls from the flying console are connected through column 74 to the below deck portion of the boat where they are appropriately connected to the respective devices, such as the rudder and engines. The flying bridge also includes a pilot seat 76.

Figure 7:
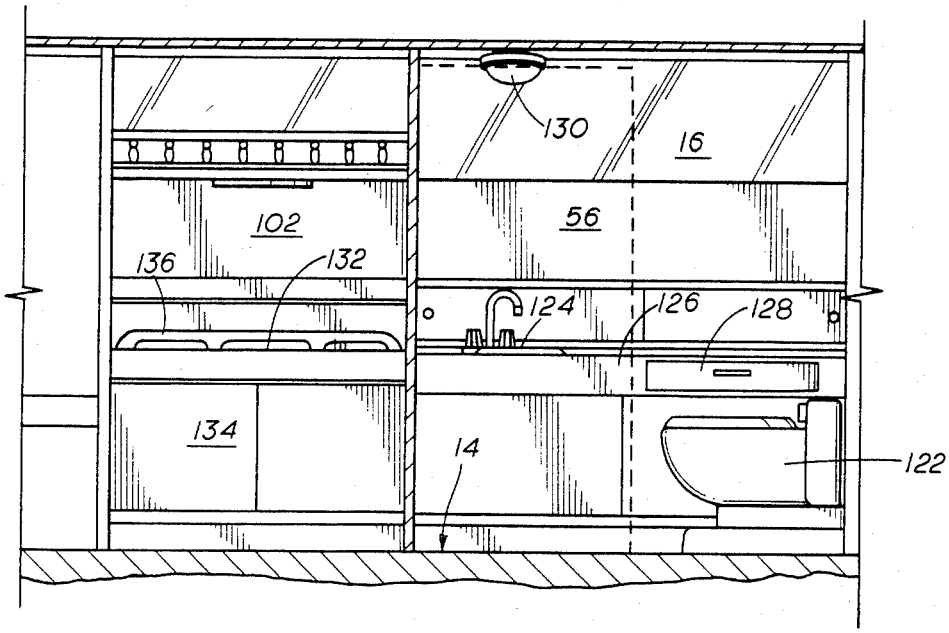
FIG. 7 is a longitudinal section taken along line 7—7 of FIG. 6.
Figure 8:
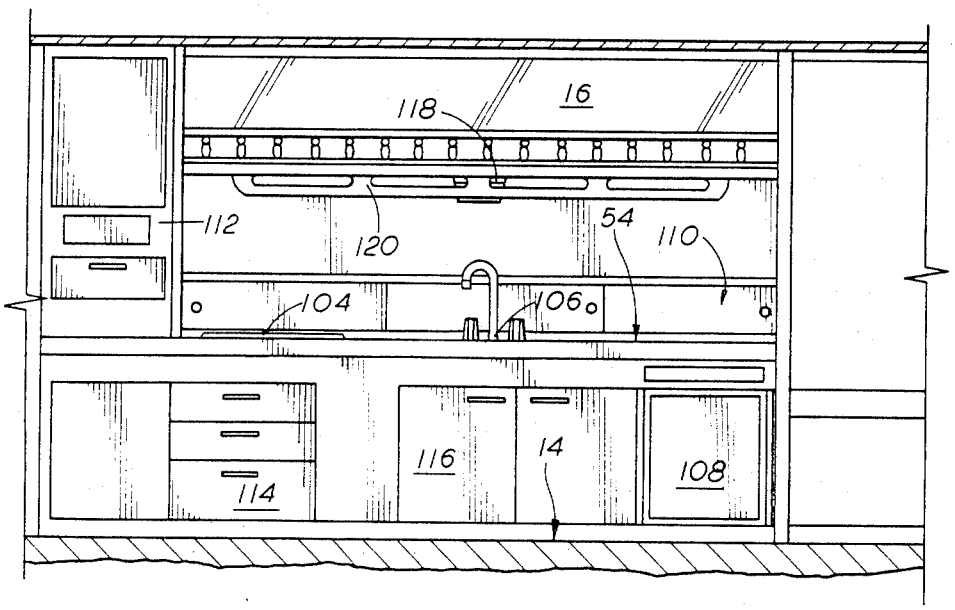
FIG. 8 is a longitudinal section taken along line 8—8 of FIG. 6.

The cabin 16 (FIGS. 4 and 6) is accessible through door 78 and hatch 80 down a short ladder 82. The door 78 is preferably provided with a coaming (not shown) in conventional fashion. The door 78 is provided with a glazed port 84, and similar ports 86, 88 are formed in bulkhead 76 to either side of the door 78. Any of these three ports could be provided with conventional means (not shown) allowing them to be opened if desired. The forward end of the cabin 16 has a rearwardly opening generally C-shaped bench 90 with an appropriately shaped table 92 centered between the open arms thereof. Bench 90 is preferably provided with lower storage compartments 94, 96, and the table 92 is preferably supported on a fixed, vertically adjustable column 98 so that the table 92 can be lowered to form a continuous extension between the arm portions of the bench 90. The cabin is shown equipped with an air conditioning unit 100. A galley 54 (FIG. 8) is on the port side of the cabin and a head 56 and bar/entertainment center 102 (FIG. 7) is on the starboard side.

The galley 54 (FIGS. 4 and 8) is provided with a range 104, a sink 106, a refrigerator 108, and enclosed storage 110. A radio and electronics compartment 112 is at the after end of the galley adjacent to and accessible from the door 78. Drawer 114 and cabinet 116, storage, lights 118 and hand rail 120 complete the galley.

The head 56 (FIGS. 4 and 7) is provided with a commode 122, sink 124, vanity 126, storage 128 and lights 130. Forward of the head 56 is a bar/entertainment center 102 which can, for example, include a bar center 132, a music system (not shown), storage 134 and hand rail 136.

Referring to FIG. 2, the overhead 138 for the cabin 16 is provided with a head vent 140, a galley vent 142, a hatch 144, an anchor locker 146 housing an anchor (not shown) and a forwardly extending bow pulpit 148. The hatch 144 can be made of a transparent, sun tinted material to provide both light and ventilation for the cabin as well as an exit, should it be necessary. Railing 150 is fixed to the hull surrounding the bow and extending well along the main deck 18. A wind screen 152 is fixed to the after end of the overhead 138 surrounding hatch 80.

The central area 32 of main deck 18 is shown provided with a table 154 mounted on the column 74. Bait boxes 156, 158 are provided on each side of the deck 18 for ready access to bait. The cleaning station 30 includes a table 160 having a sink 162 and nearby hatch 164 opening onto an underdeck iced and/or refrigerated storage 166. There is also a hatch 168 providing access to the equipment space below decks. At the after end of the boat, there are further bait boxes 170, 172 to either side of a port 174 leading to a diving platform 176.

Many details of a conventional commercial sport fishing boat have not been illustrated nor described since they do not form features of the present invention. These would include the previously mentioned below deck power plant, including engines and an electrical power source, fuel storage, water storage and the like. No details have been shown on navigation systems, including running lights, sonar, radar and other communication gear, electrical or fluid distribution systems, or deck equipment.

While it would be known to those skilled in the art, the particular configuration of and materials used in fabricating the subject commercial sport fishing boat may be varied to accommodate the desired handling and aesthetic characteristics. For example, although wood or metal, such as aluminum, may be used in fabricating the hull, decks and cabin, a fiberglass reinforced synthetic resin over a wood or metal frame is generally preferred. Experience has shown that fiberglass reinforced polyester plastic will not only provide excellent appearance and high resistance to damage and degradation due to prolonged exposure to the elements, particularly in a marine environment, but it can be fabricated readily using relatively inexpensive molds and simple hand lay-up or spray-up methods well known in the boat building industry.

The frame 22 is preferably formed of welded stainless steel tubing to provide the required strength and durability. Preferably, the frame is provided with mounting means (not shown) upon which a web of flexible material, such as nylon, can be suspended to at least partially enclose the main deck and/or the flying console, to provide protection from the elements.

As previously mentioned, a primary advantage of the present invention is the structural arrangement of the decks and cabin which provides an improved space arrangement allowing greater numbers of commercial sport fisherman per trip. Using, as an example, a 38′ boat built according to the present invention, it would provide approximately 62′ of rail space, 19′ of main deck and a 19′ cabin deck with 6′4″ of cabin overhead. The cabin deck with approximately 150 square feet of area, is large enough to accommodate a full galley with sink, stove and refrigerator, an electric head with vanity, shower and hot water, a bar/entertainment center, table and bunks, all air conditioned. The central area of the main deck has over 100 square feet of usable space, including the walkways, and a large portion of this can be enclosed by a web secured to the frame. The rear deck has approximately 88 square feet and includes a fish cleaning table, a 28 cubic foot ice box below deck, tackle storage and can even be provided with a grill for outdoor cooking. The flying console deck is approximately 96 square feet.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. An upper deck for a commercial sport fishing boat having a hull defining a peripheral rail and a lower deck fixed inside the hull with a cabin supported on said lower deck, said upper deck comprising:

a unitary member spanning said hull from rail to rail, said member defining at least one walkway extending between a portion of said rail and a like side wall of said cabin; and a bench seat facing outwardly toward said walkway, said bench seat having riser, seat and back portions forming a portion of said side wall of said cabin and providing head room inside said cabin.

2. An upper deck according to claim 1 wherein said walkway and bench extend at least part of the length of the cabin.

3. An upper deck according to claim 1 wherein a walkway and bench are provided on either side of said cabin.

4. An upper deck according to claim 1 wherein said walkway, bench and cabin are formed of reinforced fiberglass.

5. A commercial sport fishing boat comprising:

a hull;

a cabin deck supported on said hull;

a cabin on said cabin deck;

a main deck disposed on said hull in generally parallel relation spaced above said cabin deck and defining at least one walkway extending between one said wall of said cabin and the hull and an adjacent outwardly facing bench seat spaced from said hull with riser, seat and back portions of said bench seat forming said side wall of said cabin whereby overhead inside the cabin is retained while increasing rail/seating capacity of the boat.

6. A commercial sport fishing boat according to claim 5 further comprising:

a frame mounted on said main deck and cabin; and a flying console supported by said frame spaced parallel above said main deck, said flying console having steering and propulsion control means thereon connected to respective steering and propulsion means via a vertical conduit passing between said flying console and main deck.

7. A commercial sport fishing boat according to claim 5 wherein said cabin deck covers only a forward portion of said hull, said cabin being centrally located on said cabin deck, and said main deck covering substantially the remainder of said hull.

8. A commercial sport fishing boat according to claim 7 wherein said cabin includes:

a lounge, a galley and a head.

9. A commercial sport fishing boat according to claim 5 further comprising:

a plurality of bait boxes disposed along and integral with said hull.

10. A commercial sport fishing boat according to claim 5 further comprising:

a stepped down rear portion of said main deck defining a work station; and a fish cleaning table and cooler chamber in said work station.

11. A commercial sport fishing boat according to claim 5 further comprising:

a diving platform attached to the exterior of said hull and access to said platform through said hull.

12. A commercial sport fishing boat according to claim 5 wherein at least said main deck is a unitary member formed of reinforced fiberglass.

* * * * *